US005720445A

United States Patent [19]

Sakurai et al.

[11] Patent Number: 5,720,445

[45] Date of Patent: Feb. 24, 1998

[54] APPARATUS FOR WINDING REINFORCING FIBERS AROUND COLUMN

[75] Inventors: Hiroshi Sakurai; Juichi Oka, both of Nagoya; Masami Ito, Shimada; Masahiko Ideguchi, Warabi; Yuko Arimitsu; Hideo Katsumata, both of Tokyo, all of Japan

[73] Assignees: Mitsubishi Jukogyo Kabushiki Kaisha; Mitsubishi Chemical Corporation, both of Tokyo; Obayashi Corporation, Osaka, all of Japan

[21] Appl. No.: 721,035

[22] Filed: Sep. 26, 1996

[30] Foreign Application Priority Data

Nov. 17, 1995 [JP] Japan ..... 7-300220
Nov. 17, 1995 [JP] Japan ..... 7-300221

[51] Int. Cl.[6] ..... E04G 23/02

[52] U.S. Cl. ..... 242/438.1; 242/441.2

[58] Field of Search ..... 242/438.1, 438, 242/439, 439.5, 441.2, 441.3

[56] References Cited

U.S. PATENT DOCUMENTS

| | | | |
|---|---|---|---|
| 2,520,402 | 8/1950 | Hirsh | 242/438.1 |
| 3,687,380 | 8/1972 | Magers et al. | 242/438.1 |
| 3,853,277 | 12/1974 | Bush | 242/438.1 |
| 3,884,424 | 5/1975 | Bosquain et al. | 242/438.1 |
| 5,133,510 | 7/1992 | Davis et al. | 242/438.1 |

FOREIGN PATENT DOCUMENTS

| | | |
|---|---|---|
| 5-12506 | 2/1993 | Japan . |
| 6-84231 | 10/1994 | Japan . |
| 7-49721 | 5/1995 | Japan . |
| 7-49725 | 5/1995 | Japan . |

*Primary Examiner*—Katherine Matecki
*Attorney, Agent, or Firm*—Wenderoth, Lind & Ponack

[57] ABSTRACT

An apparatus for winding reinforcing fibers around a column is provided which comprises a non-rotatable annular frame provided around the column to be moved up and down; a rotatable annular frame provided upon the non-rotatable annular frame and arranged to be rotated around the column by a first driving motor on the non-rotatable annular frame; means provided on the rotatable annular frame for supplying reinforcing fibers around the column; at least three chain members for suspending the non-rotatable annular frame above the ground or floor level; and lift means provided at the periphery of the non-rotatable annular frame and engaged with the chain members to move up and down the non-rotatable annular frame by a second driving motors provided on the non-rotatable annular frame.

11 Claims, 8 Drawing Sheets

APPARATUS FOR WINDING REINFORCING FIBERS AROUND COLUMN

BACKGROUND TO THE INVENTION

This invention relates to an apparatus for winding reinforcing fibers around a column or the like.

Such an apparatus has recently been developed to reinforce old columns of buildings and support columns of bridges for railroads and roadways so as to provide resistance against strong earthquakes.

There provided various apparatus of the above type as shown in Japanese patent applications published under Nos. 5-12506, 6-84231, 7-49721 and 7-49725. In the apparatus of Nos. 5-12506, 6-84231 and 7-49725, an inner annular member and an outer annular member are provided concentrically to surround a support column, wherein one of the inner and the outer annular members is arranged non-rotatably while the other of the annular members is arranged to rotate around the column and is provided with bobbins for winding reinforcing fibers around the column. Such known apparatus however has a disadvantage that a wide area is required for installing the apparatus around the column, because the inner annular member and the outer annular member are arranged concentrically in the radial direction of the column.

To avoid such disadvantage, the apparatus of publication No. 7-49721 includes a non-rotatable annular member and a rotatable annular member arranged one upon the other around the column. The non-rotatable annular member is suspended by a plurality of support wires extended from upper support means around the upper end of the column and the rotatable annular member is placed upon the non-rotatable annular member. The non-rotatable annular member has thereon an annular guide rail upon which rest wheels provided on the bottom surface of the rotatable annular member. The rotatable annular member has an annular chain fixed thereon along the periphery thereof with which is engaged a sprocket supported by the non-rotatable annular member. The sprocket is driven by a motor supported on the non-rotatable annular member so that the rotatable annular member rotates around the column by the operation of the motor. The rotatable annular member has therein bobbins of reinforcing fibers from which the reinforcing fibers are pulled out and wound around the column while the rotatable annular member rotates around the column.

The support wires for suspending the non-rotatable annular member extend from respective winches fixedly mounted on the ground and then slidably pass through the above-mentioned support means provided around the upper end of the column. The non-rotatable annular member is arranged to be moved up and down by the operation of the winches. Thus, by changing the operational speeds of the winches, the spiral winding pitch of the reinforcing fibers around the column can be changed.

The known apparatus set forth above has a disadvantage that winches are used for moving up and down the non-rotatable annular member. That is, since the winches receive upward force corresponding to the weight of the non-rotatable annular member, each winch has to be firmly mounted on the ground. Therefore, in the event that the column to be reinforced is standing on the soil or sandy ground, a special reinforcing operation has to be performed on and under the ground for supporting the winches. Furthermore, if the column is supported from the bottom of the sea or a river, winches cannot be used.

The present invention is to improve the above disadvantages of the known apparatus and accordingly an object of the present invention is to provide an apparatus for winding reinforcing fibers around a column wherein a non-rotatable annular member, upon which a rotatable annular member rests, is moved up and down without using winches or the like firmly fixed on the ground.

Another object of the present invention is to provide an apparatus which can wind reinforcing fibers around a column supported on non-stable ground or the bottom of a sea or river.

SUMMARY OF THE INVENTION

According to the present invention, there is provided an apparatus for winding reinforcing fibers around a column and which comprises a non-rotatable annular frame to be provided around the column to be moved up and down and having a first driving motor and second driving motors, and a rotatable annular frame provided on the non-rotatable annular frame and arranged to be rotated around the column by the first driving motor on the non-rotatable annular frame. Means provided on the rotatable annular frame supplies reinforcing fibers to be wound around the column. At least three elongated supporting members suspend the non-rotatable annular frame above the ground or floor level, the supporting members to extend down from an upper periphery of the column. Lift means provided at the periphery of the non-rotatable annular frame engage with the supporting members to move up and down the non-rotatable annular frame by operation of the second driving motors.

Preferably, each elongated supporting member is a chain and each lift means comprises a pair of sprockets arranged to engage with the chain in the shape of an "S". Each second driving motor is connected to one of the sprockets.

Preferably, abutting means is provided on the non-rotatable annular frame to contact with the column to be reinforced for preventing a free movement of the non-rotatable annular frame. More preferably, at least three pole assemblies are provided around the non-rotatable annular frame to engage therewith in such a manner as to prevent a free movement of the non-rotatable annular frame. The elongated supporting members are suspended from upper ends of the pole assemblies. Each pole assembly is arranged to be extended between ground or floor and an upper deck or ceiling at the upper end of the column to be reinforced. Preferably, each pole assembly has a plurality of poles which can be expanded by connecting with another pole.

Other objects and features of the present invention will become more apparent from the following description of the present invention when taken in conjunction with the accompanying drawings, in which:

DETAILED DESCRIPTION OF THE PREFERRED EMBODIMENT

Figure 1:
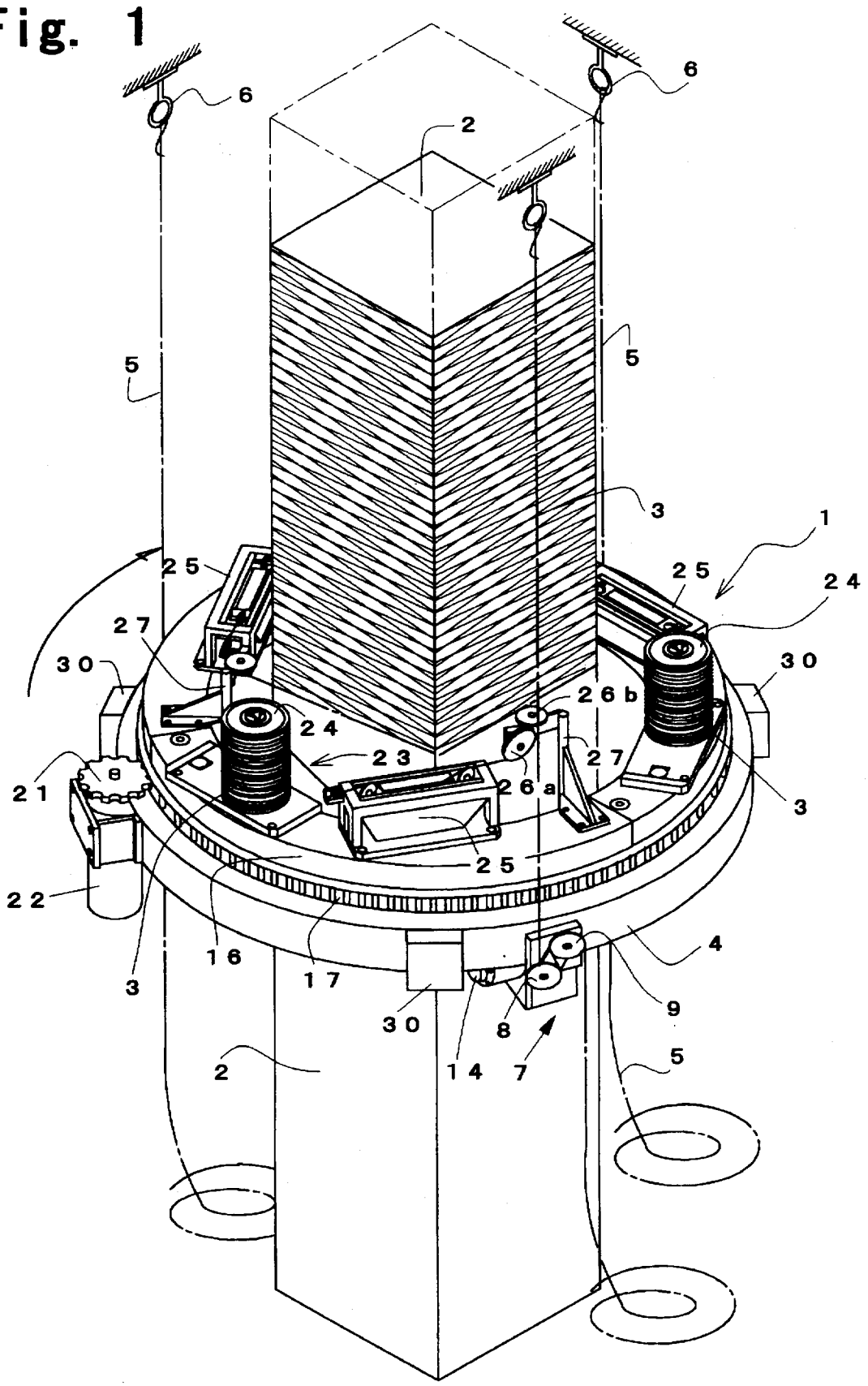
FIG. 1 is a perspective view of an apparatus according to a first embodiment of the present invention, in which the present apparatus is provided around a column of rectangular shape in section.

Referring to a first embodiment of the present invention shown in FIGS. 1 to 5, apparatus 1 is provided around a column 2 which is to be reinforced by winding reinforcing fibers 3 therearound.

The apparatus 1 comprises a non-rotatable annular frame 4 which is dividable into three arc-shaped sections for installation around and removal from the column 2. The non-rotatable annular frame 4 is suspended above the ground or floor level by three supporting chains 5 provided at angular intervals of 120 degrees around the column. Each supporting chain 5 has an upper end engaged with a metal hook 6 fixed to the bottom surface of a ceiling, slab or beam at the upper end of the column 2. The non-rotatable annular frame 4 has three sprocket means 7 on the outer peripheral surface thereof at angular intervals of 120 degrees so as to correspond to that of the supporting chains 5.

Figure 2:
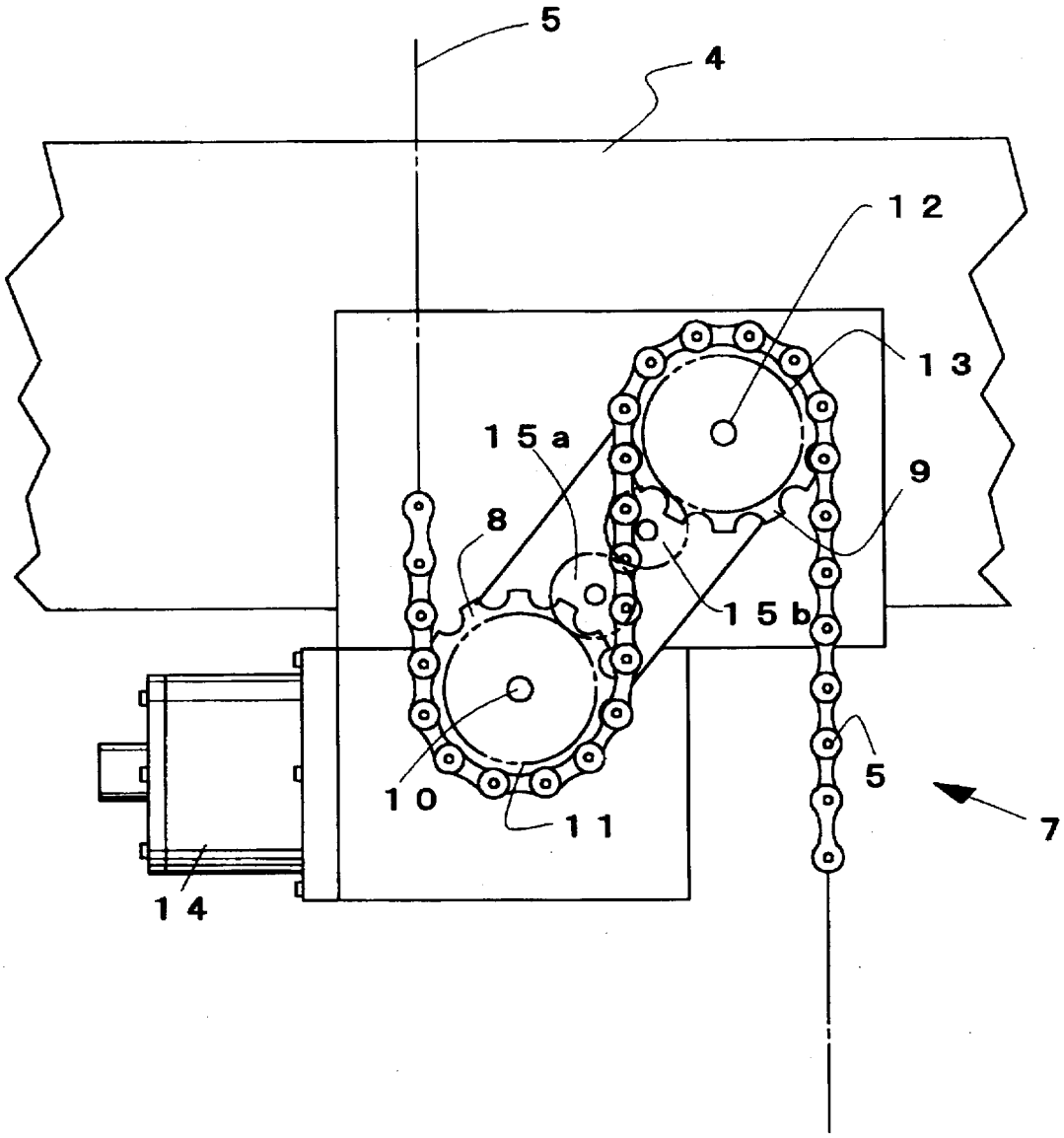
FIG. 2 is a front view showing an arrangement of sprockets and a chain for suspending a non-rotatable annular frame according to the first embodiment of the present invention.

Each sprocket means 7 comprises a lower first sprocket 8 and an upper second sprocket 9 obliquely arranged relative to each other as shown in FIG. 2. The first sprocket 8 has a first shaft 10 on which a first gear 11 is fixedly mounted, while the second sprocket 9 has a second shaft 12 on which a second gear 13 is fixedly mounted. The first gear 11 is operatively connected with a driving motor 14 fixed on the non-rotatable annular frame 4 and also is connected with the second gear 13 through two small connecting gears 15*a* and 15*b* such that the first and second sprockets 8 and 9 are rotated in opposite directions. The supporting chain 5 suspended from the metal hook 6 initially engages with the first sprocket 8 and then with the second sprocket 9 to form a shape of an "S", after which the remaining part of the supporting chain 5 hangs down from the second sprocket 9 toward the ground or floor.

The driving motors 14 for the respective three sprocket means 7 are arranged to be synchronously operated in one or the other opposite directions through a known control device (not shown), with the result that the non-rotatable annular frame 4 is caused to move up or down by means of the engagement of the supporting chains 5 and the first and second sprockets 8 and 9. That is, each supporting chain 5 is driven upward when the respective first sprocket 8 rotates in the clockwise direction and the respective second sprocket 9 rotates in the counterclockwise direction, while the supporting chain 5 is driven downward when the first sprocket 8 rotates in the counterclockwise direction and the second sprocket 9 rotates in the clockwise direction.

Figure 3:
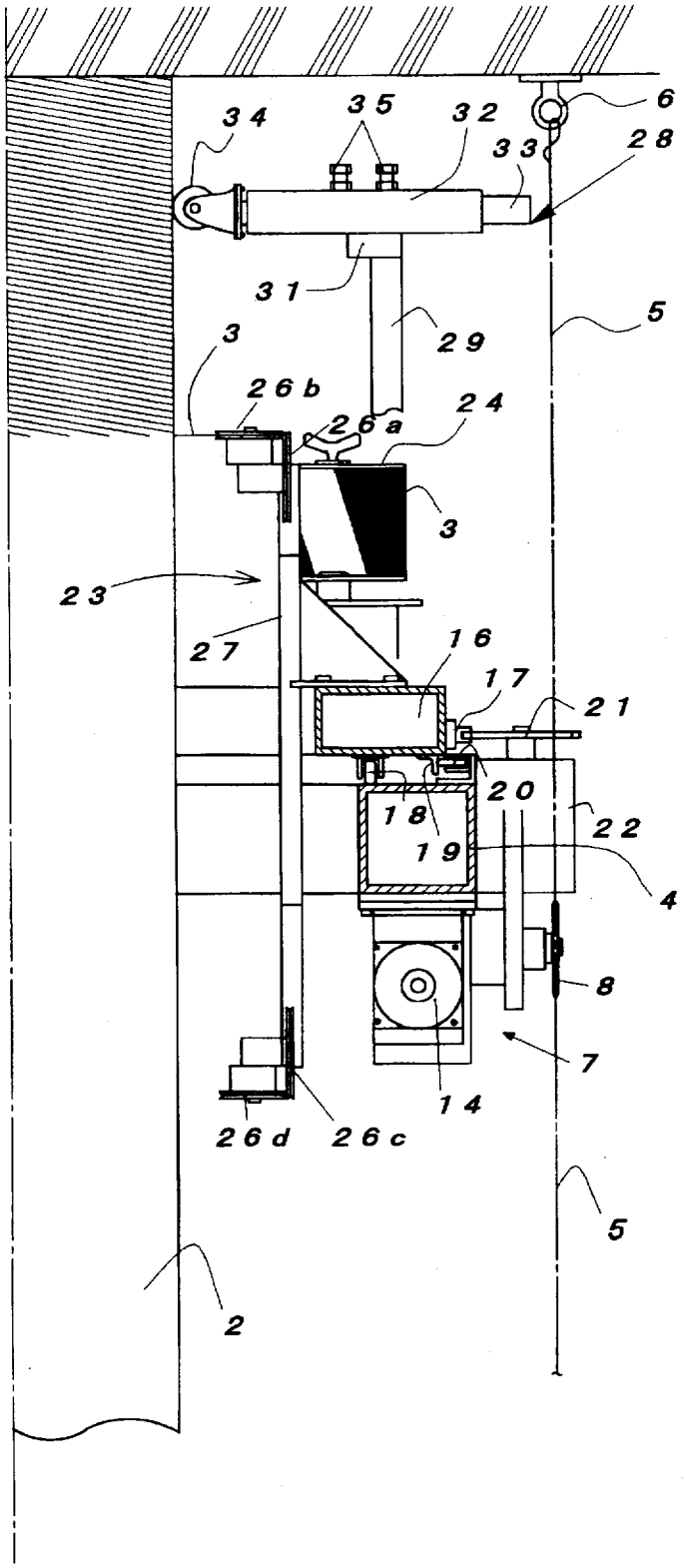
FIG. 3 is a partially sectioned vertical view showing an arrangement of the non-rotatable annular frame and a rotatable annular frame according to the first embodiment of the present invention.
Figure 4:
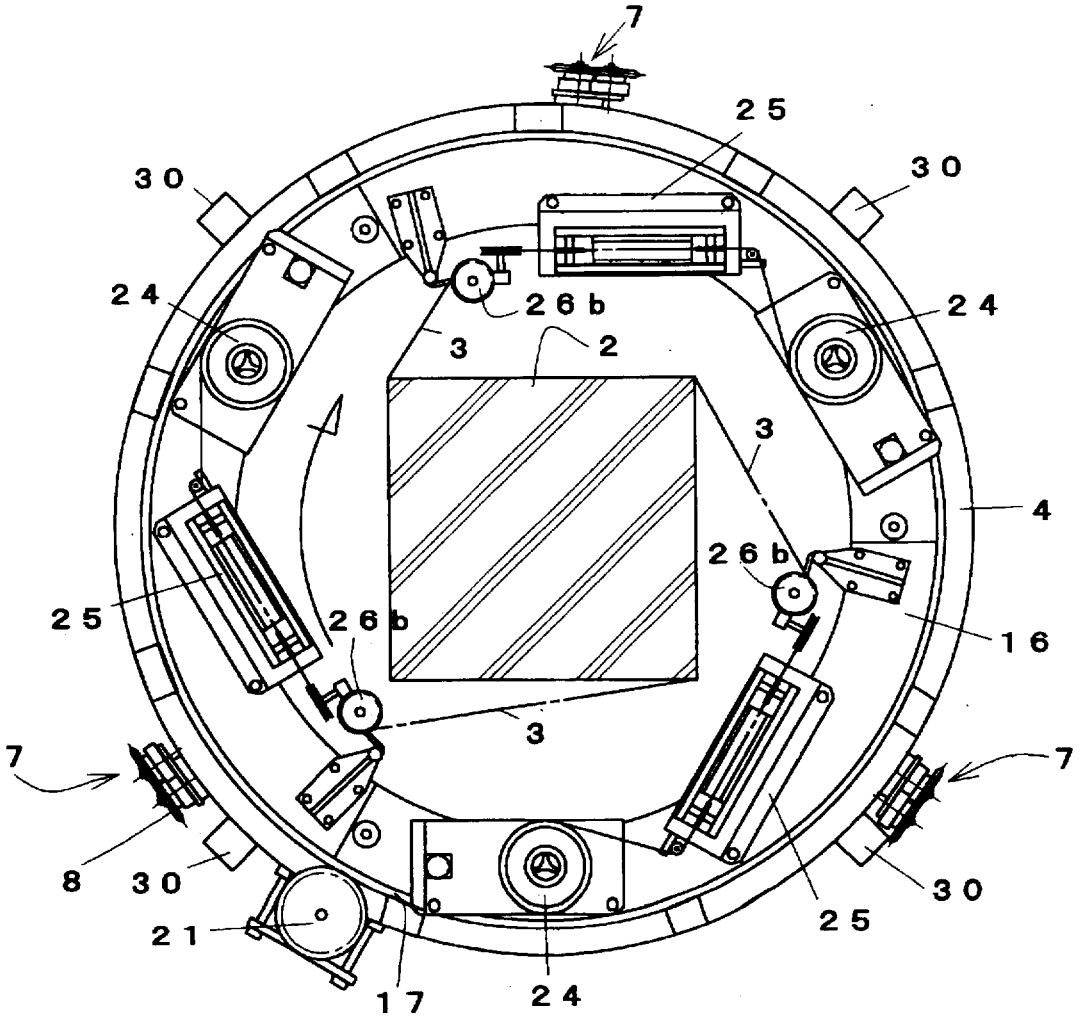
FIG. 4 is a plan view of the apparatus provided around the column with the column being in section according to the first embodiment of the present invention.

Provided on the non-rotatable annular frame 4 is a rotatable annular frame 16. As shown in FIGS. 1 and 3, the rotatable annular frame 16 has an annular chain 17 fixed on the outer peripheral surface thereof. The rotatable annular frame 16 also has wheels 18 and an annular guide frame 19 on the bottom surface thereof. The wheels 18 of the rotatable annular frame 16 run along the upper inner peripheral surface of the non-rotatable annular frame 4, while the guide frame 19 abuts against horizontal guide rollers 20 provided at the upper outer peripheral surface of the non-rotatable annular frame 4. The annular chain 17 engages with a horizontal driving sprocket 21, which is mounted on the outer periphery of the non-rotatable annular frame 4 and driven by a motor 22. With the arrangements set forth above, when the motor 22 is driven, the driving sprocket 21 is rotated, which in turn rotates the rotatable annular frame 16 on the non-rotatable annular frame 4 by the engagement with the annular chain 17. The motor 22 is also electrically connected to the known control device (not shown) so that the rotation speed of the rotatable annular frame can be controlled.

Provided on the rotatable annular frame are three sets of reinforcing fiber supply means 23, each of which comprises a bobbin 24 of the reinforcing fibers 3, a resin bath 25 filled with uncured thermosetting resin and guide pulleys 26*a* to 26*d* mounted on a guide pole 27. The guide pulley 26*a* is vertical and the guide pulley 26*b* is horizontal, both being closely adjacent to each other and provided at the upper end of the guide pole 27. Another set of guide pulleys 26*c* and 26*d* are provided at the lower end of the guide pole 27 in the same manner as the upper guide pulleys 26*a* and 26*b*. The reinforcing fibers 3 drawn from the bobbin 24 are guided to pass through the resin bath 25, so that the fibers are impregnated with the uncured thermosetting resin, and then guided through the vertical guide pulley 26*a* and horizontal guide pulley 26*b* onto the periphery of the column 2 thereon while the rotatable annular frame 16 is rotating around the column.

Figure 5:
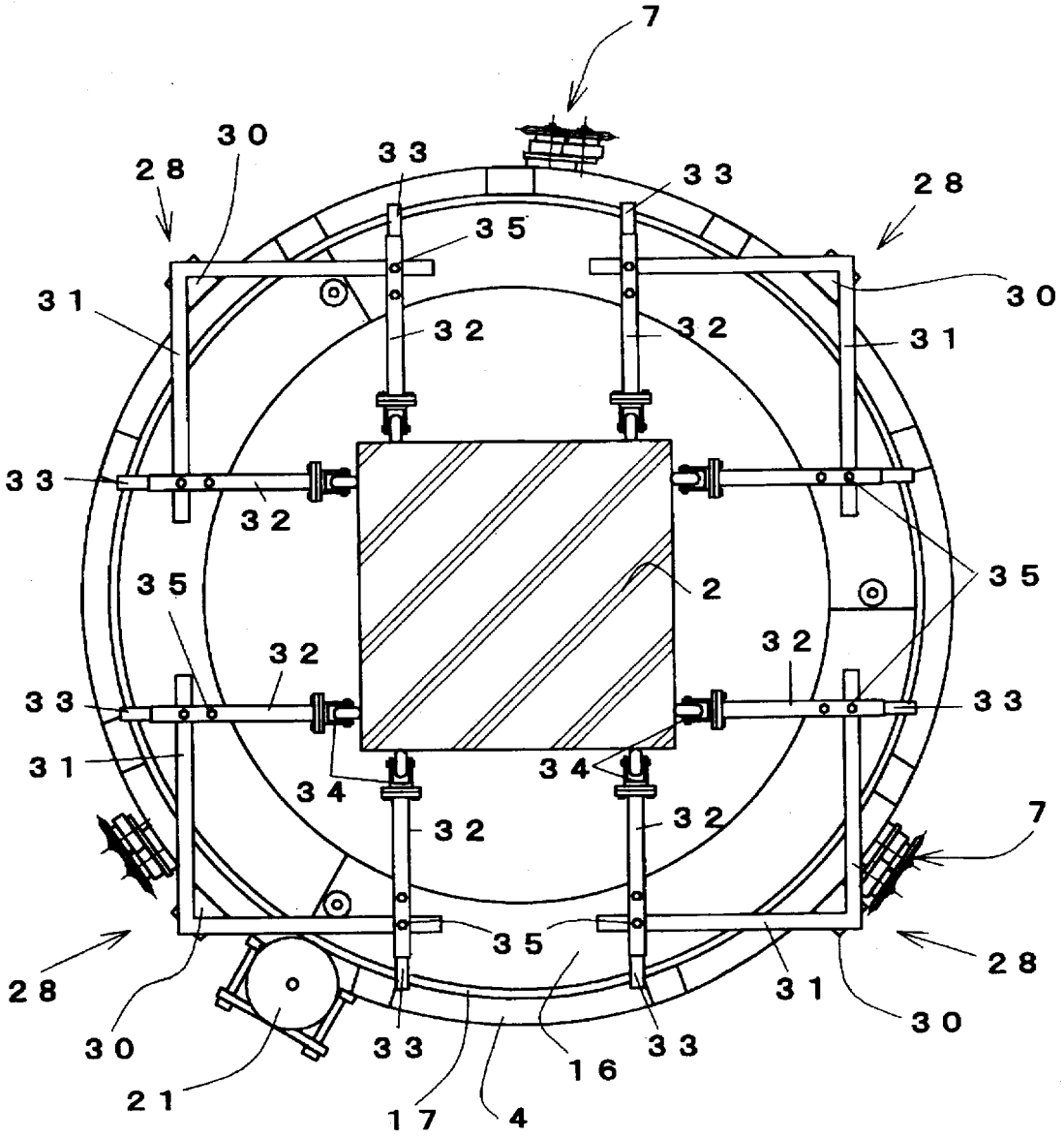
FIG. 5 is a schematic plan view showing arrangement of frame abutting members for preventing free movement of the non-rotatable annular frame according to the first embodiment of the present invention.

Also, provided on the non-rotatable annular frame 4 at angular intervals of 90 degrees along the periphery thereof are four sets of abutting means 28, as shown in FIG. 5, each of which comprises a vertical shaft 29 rectangular in section adapted to be snugly engaged at its lower end portion with a rectangular frame 30 mounted on the outer peripheral surface of the non-rotatable annular frame 4 and supporting arms 31 extending at an angle of 90 degrees and connected to the upper end of the vertical shaft 29. The supporting arms 31 each hold thereon a guide pipe 32 at an angle of 90 degrees thereto, through which an abutting rod 33 is slidably inserted. The abutting rod 33 has a roller 34 at the tip thereof which is adapted to be in contact with the surface of the rectangular column adjacent to a corner thereof. The degree of extension of the abutting rod 33 beyond the guide pipe 32 can be adjusted by sliding the former through the latter and fixed at a desired position by fastening screws 35.

Thus, a pair of abutting rods 33—33 in each of the abutting means 28 are arranged such that the rollers 34—34 at the tip of the abutting rods contact the surfaces of the column 2 with the rectangular comer thereof being interposed therebetween, so that the non-rotatable annular frame 4 is prevented from rotating together with the rotation of the rotatable annular frame 16.

The abutting means 28 will not be required in such a case that the non-rotatable annular frame 4 is so heavy that the non-rotatable annular frame 4 is prevented from rotating together with the rotation of the rotatable annular frame. However, especially when the present apparatus is used outside of a building and is subjected to strong wind, the abutting means 28 effectively prevent free movements such as swinging movement of the non-rotatable annular frame 4.

Though four sets of the abutting means 28 are provided in the embodiment set forth above, two such sets can be provided at diagonally in the opposite locations. Also, the structure or configuration of the abutting means can be changed in accordance with the sectional shape of the column.

To reinforce the column 2 by the apparatus 1 according to the first embodiment of the present invention, the non-rotatable annular frame 4 as well as the rotatable annular frame 16 are assembled around the column by connecting the divided arc-shaped pieces together. The non-rotatable annular frame 4 is suspended by three supporting chains 5 with the rotatable annular frame 16 placing thereon. The four sets of abutting means 28 are also assembled on the non-rotatable annular frame 4 as set forth above. The reinforcing fibers 3 are drawn from the bobbins 24 of the three sets of the reinforcing fiber supply means 23 and are connected to the column after passing through the resin baths 25 and guide pulleys 26*a* and 26*b* at the upper end of the guide poles 27. Then, the motor 22 for rotating the rotatable annular frame 16 as well as the driving motors 14 for lifting the non-rotatable annular frame 4 are driven simultaneously through the control device (not shown). Thereby, the rotatable annular frame 16 starts rotating on the non-rotatable annular frame 4 around the column and the non-rotatable annular frame 4 starts lifting along the column 2 with the result that the reinforcing fibers 3 are wound around the column in spiral form. At this time, by controlling the speed of the driving motors 14, the lifting speed of the non-rotatable annular frame 4 is controlled. Likewise, by controlling the speed of the motor 22, the rotational speed of the rotatable annular frame 16 is controlled. Thus, by controlling the speeds of both of the driving motors 14 and other motor 22,respectively, the pitch of the spiral winding of the reinforcing fibers can be controlled as desired.

When the reinforcing fibers 3 are wound up to the upper end of the column 2, the rotary direction of the driving motors 14 is reversed, while the rotary direction of the motor 22 is kept as it is, so that the rotatable annular frame 16 rotates in the same direction and the non-rotatable annular frame descends to wind the reinforcing fibers 3 in a direction to cross the previously wound fibers, as shown in FIG. 1. Then, when the non-rotatable annular frame 4 descends to a certain level, for example to the original position, the reinforcing fibers 3 are removed from the guide pulleys 26*a* and 26*b* at the upper end of the guide pole 27 and then set to pass through the guide pulleys 26*c* and 26*d* at the lower end of the guide pole 27. Thereafter, the non-rotatable annular frame 4 is lifted by operating the driving motors 14 only to a level where the lower guide pulleys 26*c* and 26*d* can take the previous original position of the upper guide pulleys 26*a* and 26*b*. From this position, the rotatable annular frame 16 again is rotated in the same direction as before and the non-rotatable annular frame 4 restarts to descend. Thereby the reinforcing fibers are wound in the same spiral pitch around the lower end of the column, from where the non-rotatable annular frame 4 again is lifted while the rotatable annular frame 16 keeps rotating in the same directions up to the original starting position. Such operations are repeated if necessary.

Figure 6:
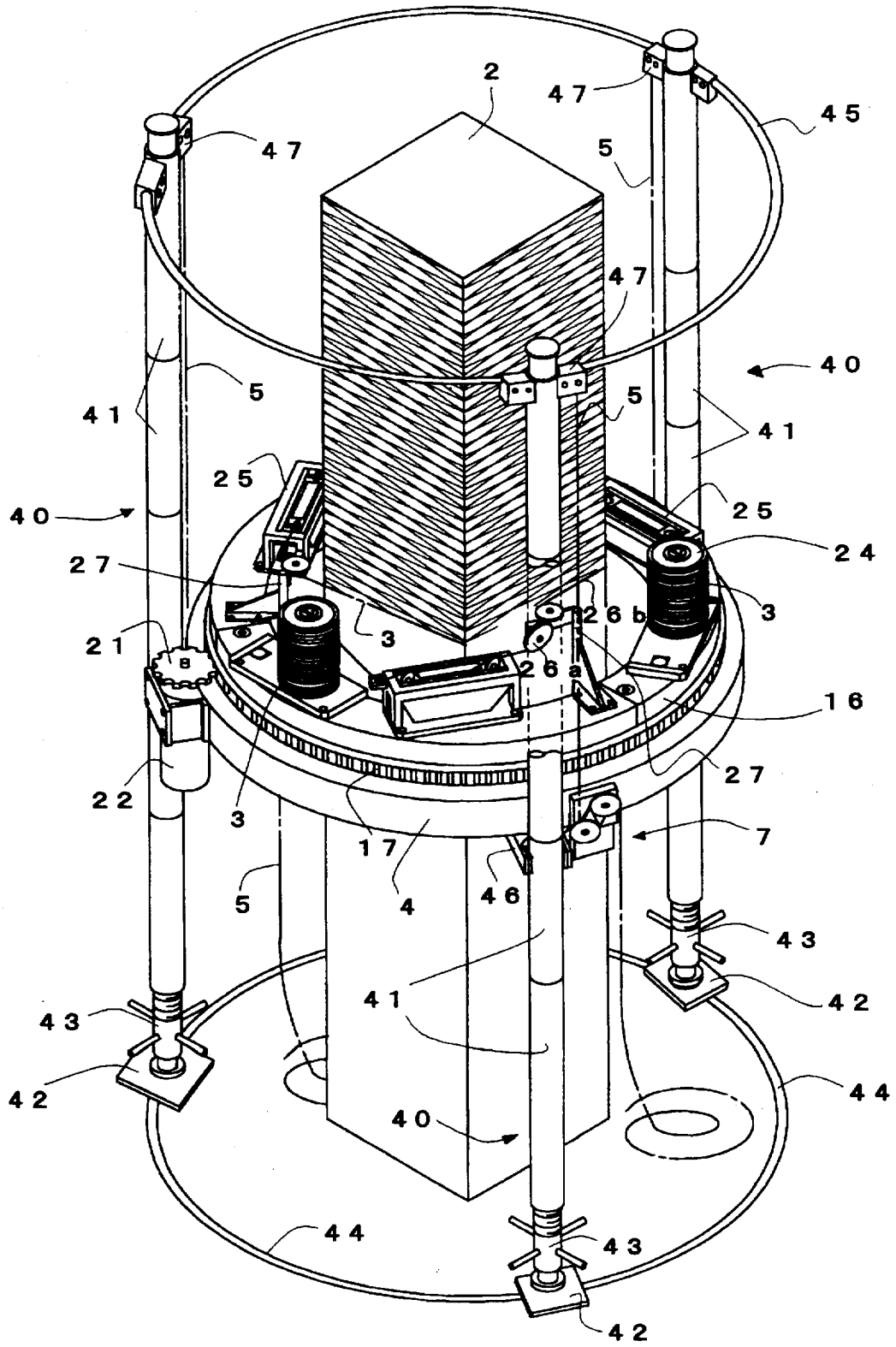
FIG. 6 is a perspective view of an apparatus according to a second embodiment of the present invention, shown provided around a column of rectangular shape in section.
Figure 7:
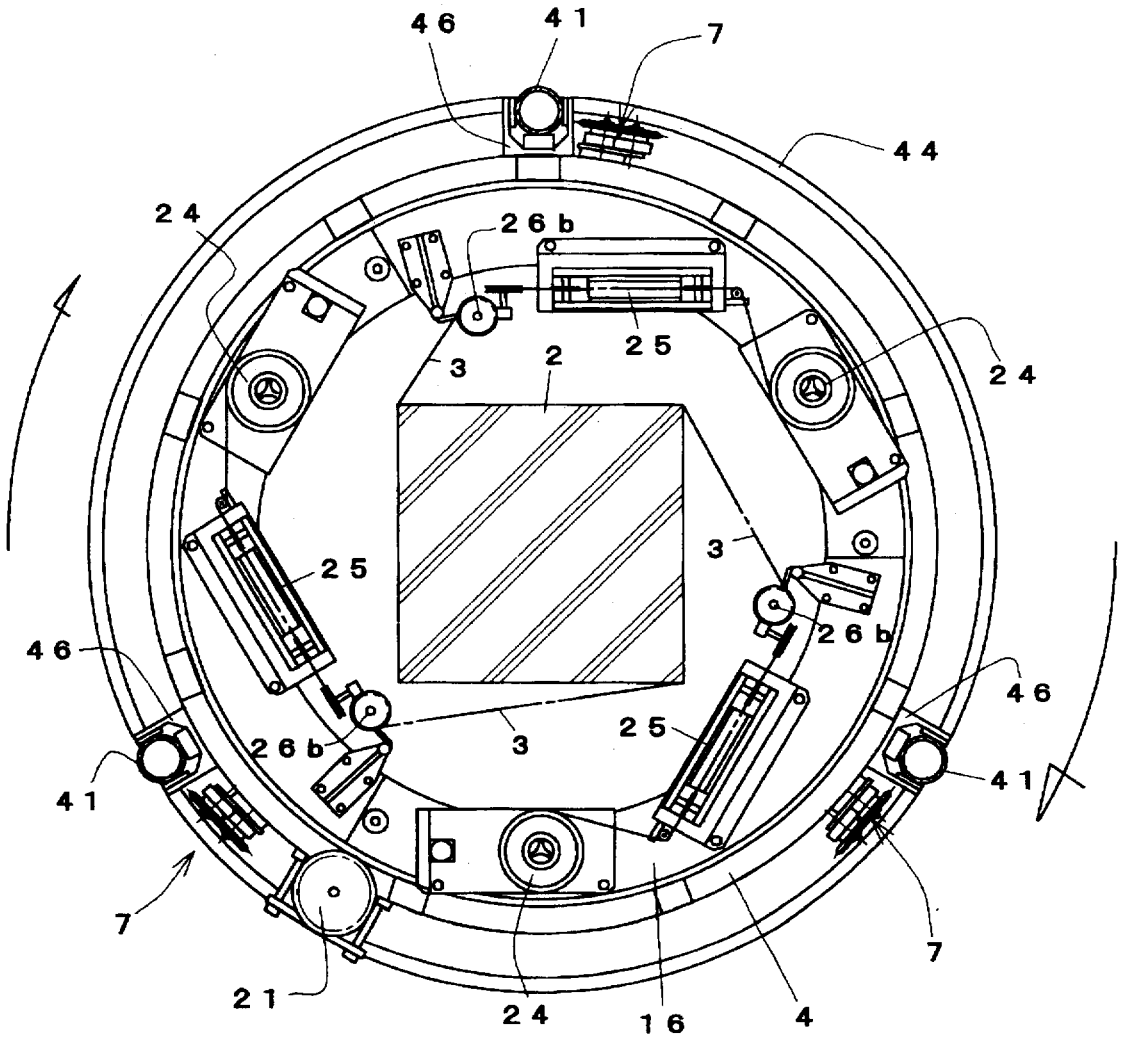
FIG. 7 is a plan view of the apparatus provided around the column with the column being in section according to the second embodiment of the present invention.
Figure 8:
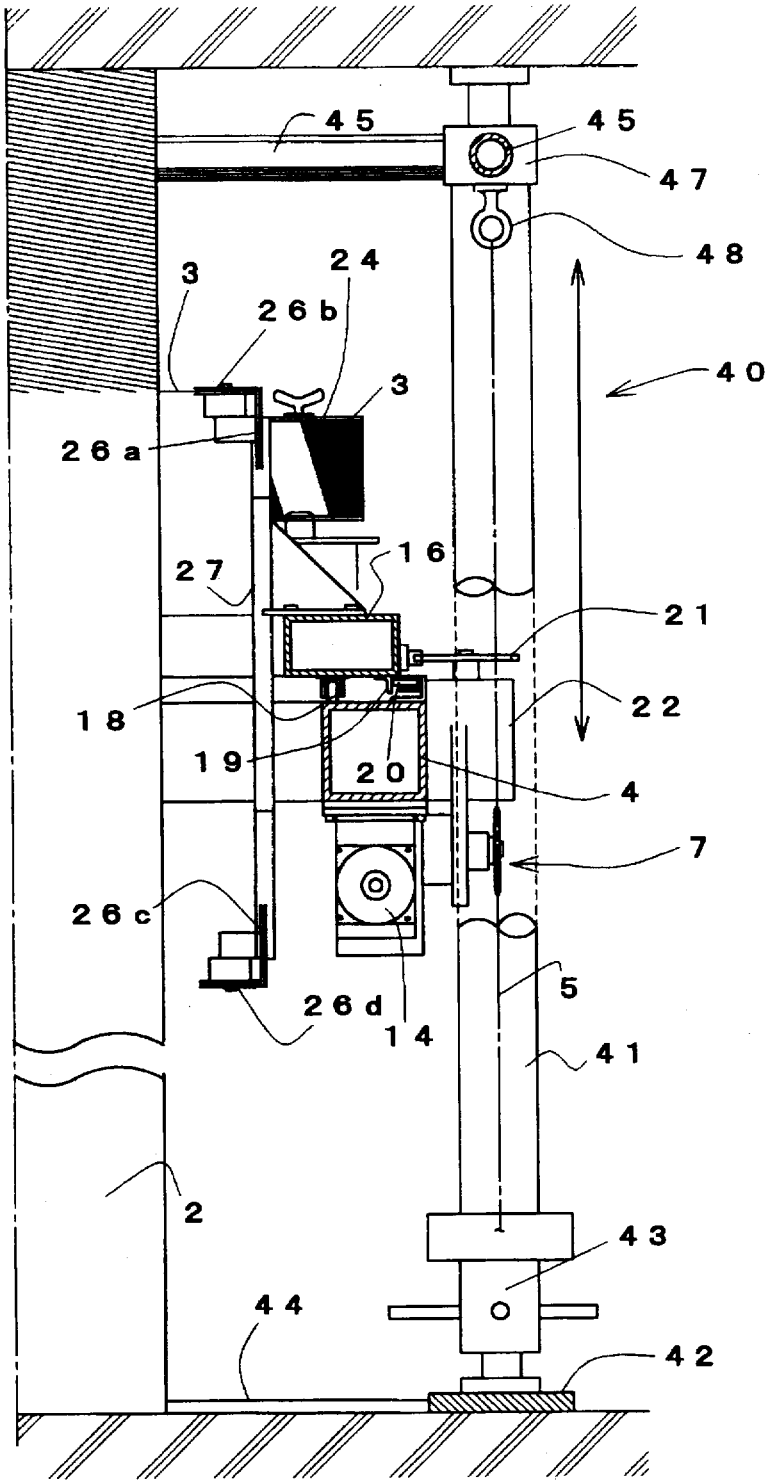
FIG. 8 is a partially sectioned vertical view showing an arrangement of a non-rotatable annular frame and a rotatable annular frame according to the second embodiment of the present invention.

In another embodiment of the present invention shown in FIGS. 6 to 8, three vertical pole assemblies 40 are provided around the non-rotatable annular frame 4 at angular intervals of 120 degrees. Each pole assemblies 40 has a plurality of poles 41 of predetermined length, each pole having screw threads to be connected with adjacent poles. The lower end of the lowermost pole 41 is connected with a base plate 42 by means of a rotatable screw adjusting means 43, so that the total length of the vertical pole assemblies 40 can be adjusted by rotating the screw adjusting means 43. The base plates 42 are connected with each other by a lower connecting ring 44 dividable into three sections. The upper end portions of the three vertical pole assemblies 40 are also connected by an upper connecting ring 45 also dividable into three sections. The middle portion of each of the three vertical pole assemblies 40 is vertically slidably engaged with a bracket 46 fixed to the outer periphery of the non-rotatable annular frame 4, brackets 46 being spaced around frame 4 at angular intervals of 120 degrees. The upper end portion of each of the three vertical pole assemblies 40 has a block 47 at the intersection with the upper connection ring 45. Each block 47 has a metal hook 48 for hanging a respective supporting chain 5 which is engaged with a respective sprocket means 7 of the same construction as the first embodiment.

The other structures of the second embodiment such as for vertically moving the non-rotatable annular frame, for rotating the rotatable annular frame and for supplying the reinforced fibers around the column are the same as mentioned in the first embodiment. Therefore, according to the second embodiment shown in FIGS. 6 to 8, the same reference numerals are used for the same parts as the first embodiment.

In operation of the second embodiment of the present invention, three vertical pole assemblies 40 are set around the column to be reinforced together with the lower connecting ring 44 and the upper connecting ring 45. The length of each of the vertical pole assemblies 40 are adjusted by connecting the poles 41 with each other and also by adjusting the screw adjusting means 43 at the lower end of the vertical pole assemblies 40, so that the upper end of each of the vertical pole assemblies 40 is firmly pressed against the lower surface of the ceiling or upper slab at the upper end of the column. The vertical pole assemblies 40 are engaged with the brackets 46 of the non-rotatable annular frame 4 to prevent free movement of the latter, thus eliminating the use of the abutting means 28 of the type used in the first embodiment. The supporting chains 5 are hung by the metal hook 48 connected to the upper end of the vertical pole assemblies 40.

Other constructions and the operation of the apparatus in the second embodiment are substantially the same as those of the first embodiment and therefore explanations thereof are omitted.

Although the present invention has been described with reference to preferred embodiments of the present invention, many modifications and alterations may be made within the scope of the present invention.

What is claimed is:

1. An apparatus for winding reinforcing fibers around a column, said apparatus comprising:

a non-rotatable annular frame member to be positioned around the column, said non-rotatable annular frame member having thereon first driving motor means and second driving motor means;

a rotatable annular frame member provided on said non-rotatable annular frame member, said rotatable annular frame member being rotatable relative to said non-rotatable annular frame member and to be around the column by said first driving motor means on said non-rotatable annular frame members;

means on said rotatable annular frame member for supplying reinforcing fibers to be wound around the column as said rotatable annular frame member is rotated therearound;

at least three elongated supporting members in the form of chains to be mounted to extend downwardly from an upper periphery of the column to support said non-rotatable annular frame member above ground or floor levels;

lift means for moving said non-rotatable annular frame member upwardly and downwardly relative to the column by operation of said second driving motor means, said lift means comprising sprockets provided at a periphery of said non-rotatable annular frame member, said sprockets being engaged with said chains and being coupled to said second driving motor means.

2. An apparatus as claimed in claim 1, wherein said sprockets comprise pairs of sprockets, each said pair of sprockets being engaged with a respective said chain in the shape of an S, said second driving motor means being connected to one said sprocket of each said pair of sprockets.

3. An apparatus as claimed in claim 2, comprising at least three said pairs of sprockets.

4. An apparatus as claimed in claim 3, wherein said second driving motor means comprises three driving motors mounted at said periphery of said non-rotatable annular frame member, each said driving motor being connected to said one sprocket of a respective said pair of sprockets.

5. An apparatus as claimed in claim 1, further comprising abutting means provided on said non-rotatable annular frame member to contact the column to prevent free movement of said non-rotatable annular frame member.

6. An apparatus as claimed in claim 5, wherein said abutting means comprises plural abutting members spaced around said non-rotatable annular frame member.

7. An apparatus as claimed in claim 1, further comprising at least three pole means provided around said non-rotatable annular frame member and in engagement therewith to prevent free movement of said non-rotatable annular frame member, said chains being hung from upper ends of respective said pole means.

8. An apparatus as claimed in claim 7, wherein said pole means are adapted to extend from a floor or ground level to an upper deck or ceiling.

9. An apparatus as claimed in claim 8, wherein each said pole means comprises a plurality of poles that may be connected to expand said pole means.

10. An apparatus as claimed in claim 7, wherein each said pole means comprises a plurality of poles that may be connected to expand said pole means.

11. An apparatus as claimed in claim 1, further comprising an annular chain fixed on an outer periphery of said rotatable annular frame member, said first driving motor means comprises a driving motor mounted on said non-rotatable annular frame member and engaged with said annular chain.

* * * * *